US005862774A

United States Patent [19]

Moss

[11] Patent Number: 5,862,774

[45] Date of Patent: Jan. 26, 1999

[54] ELECTRICAL WIRE IDENTIFICATION MARKING METHODS AND SYSTEMS

[76] Inventor: Kurt A. Moss, 9430 Greenbriar Dr., Hickory Hills, Ill. 60457

[21] Appl. No.: 678,176

[22] Filed: Jul. 11, 1996

[51] Int. Cl.[6] ..... H01B 7/36

[52] U.S. Cl. ..... 116/200; 40/316; 174/112

[58] Field of Search ..... 116/278, 200; 40/316; 174/112

[56] References Cited

U.S. PATENT DOCUMENTS

| | | | |
|---|---|---|---|
| 1,281,288 | 10/1918 | Carley | 40/316 |
| 1,607,432 | 11/1926 | Bryce | 174/112 |
| 2,106,048 | 1/1938 | Candy, Jr. | 40/316 |
| 2,372,994 | 4/1945 | Welch | 40/316 |
| 2,831,277 | 4/1958 | Strachan | 40/316 |
| 2,850,819 | 9/1958 | Payne | 40/316 |
| 3,197,554 | 7/1965 | Baker | 174/112 |
| 4,500,223 | 2/1985 | Downing, et al. . | |
| 4,578,136 | 3/1986 | Brown | 40/316 |
| 4,609,208 | 9/1986 | Wrobel | 40/316 |
| 5,350,885 | 9/1994 | Falciglia et al. | 174/112 |

FOREIGN PATENT DOCUMENTS

| | | | |
|---|---|---|---|
| 903715 | 10/1945 | France | 40/316 |

OTHER PUBLICATIONS

Product No. PWM–PK–3 (1–45) from W. H. Brady Co., 1986.

E–Z–Code Pocket Pack Wire Markers, Cat. No. WM–0–45 from Thomas & Betts Corporation, 1980.

Pan–Code Wire Marker Book, PCMB–3 (10 markers each 1 thru 45) from Panduit Corporation, no date.

Product No. PSCB–3 from Panduit Corporation, no date.

*Primary Examiner*—Diego F. F. Gutierrez
*Assistant Examiner*—Andrew Hirshfeld
*Attorney, Agent, or Firm*—Cook, McFarron & Manzo, Ltd.

[57] ABSTRACT

An electrical wire marker, marking method and system for identifying a wire associated with a particular circuit or to be installed in a particular electrical circuit are disclosed. The wire marker includes an identifier and color indicia. The identifier is associated with a particular electrical circuit in which the wire is to be connected. The color indicia corresponds to a particular color or wire color associated with that particular electrical circuit.

20 Claims, 3 Drawing Sheets

| BLACK | RED | BLUE | BLACK | RED | BLUE |
|---|---|---|---|---|---|
| 1 2 3 4 | 5 6 | 7 8 | 9 10 | 11 12 | |
| 1 2 3 4 | 5 6 | 7 8 | 9 10 | 11 12 | |
| 1 2 3 4 | 5 6 | 7 8 | 9 10 | 11 12 | |
| 1 2 3 4 | 5 6 | 7 8 | 9 10 | 11 12 | |
| 1 2 3 4 | 5 6 | 7 8 | 9 10 | 11 12 | |
| 13 14 15 16 | 17 18 | 19 20 | 21 22 | 23 24 | |
| 13 14 15 16 | 17 18 | 19 20 | 21 22 | 23 24 | |
| 13 14 15 16 | 17 18 | 19 20 | 21 22 | 23 24 | |
| 13 14 15 16 | 17 18 | 19 20 | 21 22 | 23 24 | |
| 13 14 15 16 | 17 18 | 19 20 | 21 22 | 23 24 | |
| 25 26 27 28 | 29 30 | 31 32 | 33 34 | 35 36 | |
| 25 26 27 28 | 29 30 | 31 32 | 33 34 | 35 36 | |
| 25 26 27 28 | 29 30 | 31 32 | 33 34 | 35 36 | |
| 25 26 27 28 | 29 30 | 31 32 | 33 34 | 35 36 | |
| 25 26 27 28 | 29 30 | 31 32 | 33 34 | 35 36 | |

24 26 28 30

ELECTRICAL WIRE IDENTIFICATION MARKING METHODS AND SYSTEMS

FIELD OF INVENTION

The present invention generally relates to markers for identifying energy transmission conduits such as electrical wires and the like. More particularly, the present invention relates to electrical wire markers, marking methods and systems for identifying a wire associated with a particular circuit or to be installed in a particular electrical circuit.

BACKGROUND

In the United States, there are two common commercial alternating current electrical services—208 volts, three phase, and 480, three phase. In three phase electrical service there are typically four wires. Three so-called hot wires and one so-called neutral wire or grounded conductor. Typically, each hot wire is associated with one of the three phases. By identifying each wire with a particular phase, such as phase A, B, or C, the wiring may be installed in a manner to limit the induction that may occur as current flows through the wire. This is a well-known property of electricity transmission and is typically taken into account in designing commercial electrical services.

To aid the electrician in properly installing or servicing three-phase electrical installations, it has been a trade standard to use wiring that is color coded for each phase. For example, in the United States in the Chicago, Ill., metropolitan area, it has been at least a trade standard to color code wires as follows: in 208 volt three-phase service, a black wire for phase A, a red wire for phase B, a blue wire for phase C, and a white wire for neutral. As is well-known, electrical wiring typically comprises a solid or stranded copper core covered by an insulator of normally solid color. The colors identified above refer, of course, to the color of the insulator over the copper conductor. For 480 volt three-phase service, it has been at least a trade standard in the Chicago, Ill., metropolitan area to use brown, orange and yellow wires for phases A, B, and C, respectively, and grey for neutral.

In the typical electrical distribution equipment for three-phase alternating current, the phases are sequential. For example, in the power distribution panel, circuits 1 and 2 may be A phase, 3 and 4 may be B phase, 5 and 6 may be C phase, and so on, up to as many as 42 circuits. Thus, the colors associated with a particular circuit or phase are repeated sequentially.

When an electrician installs the wires associated with a particular circuit, the electrician must install a wire of the proper color and keep track of the circuit in which it is to be installed. Previously, the electrician would tag the wire with an adhesive marker bearing the particular circuit number. For example, if the electrician is required to install electrical wire for circuit 23 in a 208 volt, three-phase service, he must recognize that circuit 23 is associated with the C phase and the color code for the C phase is blue. To figure out that the proper color wire for circuit 23 is blue is both time consuming and subject to potential error by the electrician. This can be especially important when the installation requires many wires to be pulled through the conduit. If, for example, a blueprint requires the electrician to pull wires for many different circuits through the same conduit, the electrician needs to know quickly what color is associated with each particular circuit, and substantial time and money is wasted if an incorrect wire is pulled.

It is well-known in the electrical service installation area to attach numerical labels to each wire that is associated with a particular circuit and/or phase. These labels have typically been provided in sheets or small booklets of sheets containing a series of adhesive-backed strips bearing one of a series of numbers. For example the W. H. Brady Company of Milwaukee, Wis., supplies such wire markers under its part number PWM-PK-3. Similar wire markers are provided also by other manufactures such as Thomas & Betts of Memphis, Tenn., and the Panduit Company of Tinley Park, Ill. Typically these pull-off labels or strips use black numbers on a white background. However, numbers are also available in other color backgrounds, but typically the background color has no relationship to the color of the wire to be installed, and an entire series of numbers, such as 1–50, are provided on labels having the same color background. Suppliers have also supplied different color tags that are blank.

Accordingly, none of the known prior art wire markers have taken into account the difficulty that electricians face when having to pull a large number of wires associated with many circuits to assure that the proper color wire is associated and installed for the proper circuit or phase.

Accordingly, it is general object of the present invention to provide a wire marker, method and system that overcomes the drawbacks of the prior art and assists the electrician in determining and installing the proper wire for the proper circuit or phase.

SUMMARY OF THE INVENTION

In accordance with the present invention, an electrical wire marker attachable to an electrical wire is provided which comprises an identifier such as a number, that is associated with a particular electrical circuit in which the wire is to be installed and connected, and an indicator, for example a color indicia, such as a particular color of the identifier or a background color on the marker itself, corresponding to the particular color associated with the electrical circuit or phase or the color of the wire to be connected in such circuit.

By way of example only, for use with wiring installed in a 208, three-phase service, in a power distribution panel having 42 circuits, the electrical wire markers may be numbered sequentially 1 through 42, with the number 1 being black on a white background, the number 2 being red on a white background the number 3 being blue on a white background color, the number 4 being black on a white background color, the number 5 being red on a white background color, the number 6 being blue on a white background color, the number 7 being black on a white background color, the number 8 being red on a white background color, the number 10 being blue on a white background color, etc., with this order repeating up through 42.

With such a marker, if the electrician were required to pull, for example, a wire in a 208 volt three-phase service for circuit 23, the electrician could, by merely looking at the number 23 on the marker see by its color the color wire which must be installed for that particular circuit and phase. The electrician could then select the proper color wire, attach the label in the typical fashion that prior labels have been attached and install the wire, confident that the correct color has been installed for the correct circuit and phase. Alternatively, the color indicia could be provided by the background color itself, or by some other portion of the marker to be attached to the wire.

Therefore, in accordance with the method provided by the present invention, the electrician could readily and confidently identify and connect a particular color electrical wire to a particular circuit of a three-phase alternating current distribution source with the following steps. First, the electrician would determine the identifier, such as the number, associated with the circuit/phase. This would typically be found, for-example on the electrical installation drawing, which instructs the electrician to install or pull a wire for a circuit or circuits of particular numbers. The electrician would then consult the source of electrical wire markers provided in accordance with the present invention, in which each marker has associated with it a particular identifier, such as circuit number, and a corresponding color that is associated with the phase of that circuit, or with the wire to be installed in that circuit. The electrician could readily determine from that color identifier the particular color associated with the wire to be installed, select that color electrical wire, attach the appropriate marker and install it in the conduit, trough, raceway or other wire installation system provided in the particular electrical service.

The foregoing description is provided for purposes of summary only, and additional details and features of the present invention are as set forth below in the detailed description of preferred and alternative embodiments thereof.

DETAILED DESCRIPTION OF THE DRAWINGS

Figures 1, 2:
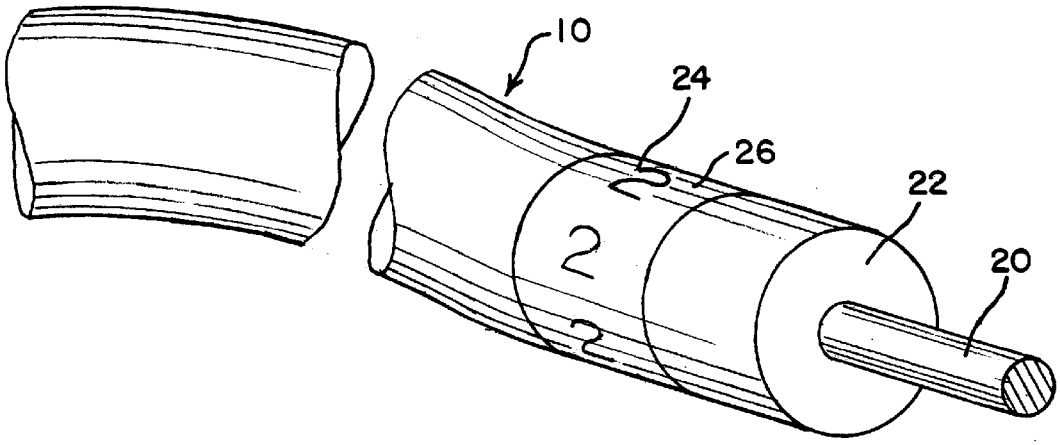
FIG. 1 is a partial perspective view of the typical wire having an inner drawn or extruded conductive core and an outer insulative plastic or rubber cover.
FIG. 2 is a plain view of a source or sheet of markers embodying the present invention, in which the wire markers contain a number corresponding to the circuit in which it is to be installed and a color corresponding to the proper color wire associated with that particular circuit and phase for application in a 208 volt three-phase electrical system.

FIG. 1 is a perspective view of a typical electrical wire 10 carrying a marker embodying the present invention. The typical electrical wire includes an inner electrical conductor 20, such as drawn or extruded copper, covered by an insulative coating 22 of plastic or rubber. It is common for wires to be available with different color plastic coverings or coatings. When the present invention refers to a different color wire, it is intended to refer to a wire having a different color plastic or rubber coating or covering 22. While wires are provided typically of solid color, it is within the scope of the present invention to include wires which have a covering such as white with a color coding by way of a linear or spiral stripe in the otherwise white covering or coating 22. Accordingly, a reference to a blue wire includes a wire in which the coating or covering is entirely blue or a white wire having a blue linear, spiral or similar stripe or stripes in order to distinguish it from wires having stripes of other colors. This is conventional, however, and the present invention is not embodied in the color or color-coded wire per se.

In accordance with the present invention, a wire marker is provided, such as marker 24 shown on the wire in FIG. 1. The marker 24 typically comprises a strip or band of material having an outside visible surface 26 and an undersurface which generally carries an adhesive for attaching the marker to the surface of the wire. The outside or indicia bearing surface 26 of the marker carries an identifier 28, typically a number from 1 to 45 or higher, corresponding to the circuit of an electrical supply panel or circuit breaker panel from which the circuit extends.

In accordance with the present invention, the marker also includes a color indicia that corresponds to a particular color associated with the phase of the electrical circuit or with the wire to be connected to the circuit. For example, the color indicia may be the color of the identifier, such as the number, found on the marker. In other words, the marker may have a white or otherwise neutral background color on the indicia bearing surface, and the actual color of the identifier would represent the particular color of the wire that is associated with and to be installed in that electrical circuit/phase. More specifically, for example, in a 208 volt three-phase service, a black number on a white or neutral color surface of the marker would be used for circuits 1, 2, 7, 8, 13, 14, 19, 20, 25, 26, 31, 32, 37, 38, 43 and 44. Those colors, for example, correspond to the color of the wire to be installed in connection with those circuits in accordance with the standard electrical installation practice in the metropolitan area of Chicago, Ill. Similarly, a red number on a white or neutral background would be used for circuits having identifier numbers 3, 4, 9, 10, 15, 16, 21, 22, 27, 28, 33, 34, etc. And blue numbers on a white or neutral background could be used for blue wires to be connected to circuits 5, 6, 11, 12, 17, 18, 23, 24, 29, 30, etc. For 480 volt, three-phase service, the colors may be brown, orange and yellow in repeating sequence, in accordance with local Chicago, Ill. practice, or using different colors in accordance with practice in other areas.

Wire markers bearing numbers, as indicated in the background, have heretofore been available. One example of a prior art source of such markers is described in U.S. Pat. No. 4,500,223, the description of which is incorporated by reference herein.

FIG. 2 shows one example of a page 30 of markers 24 that could be used in a marker source or carrier such as set forth in the above-identified patent. As shown in FIG. 2, a page comprises a series of elongated rectangular removable labels or strips each having a different number corresponding to the number of the circuit in which a wire is to be connected or installed. Each marker has series of identifiers or numbers 28 so that the identifier will be visible from any perspective after the marker is applied to the surface of the wire. Each marker has an adhesive coating on the underside, and is mounted on a support material with a release agent or a covering that allows the marker and adhesive to be peeled away from the underlying support paper or layer. This is in accordance with prior wire markers and marking systems and no claim is made to the uniqueness of the underlying adhesive coating or release materials or papers as these are all well-known in the prior art. In accordance with the present invention, however, each identifier is of a particular color, corresponding to the color of the wire that is associated with the particular circuit and phase according to installation practice or code requirement. As can be seen, for example, in FIG. 2, the identifiers 1, 2, 7, 8, 13, 14, etc. are black on a white background to correspond to the black color of the wire that is to be installed in circuits 1, 2, 7, 8, 13, 14, etc. Identifiers 3, 4, 9, 10, 15, 16, etc. are red on a white or neutral background because a red wire is to be installed in those circuits. Similarly, identifiers 5, 6, 11, 12, 17, 18, etc. are blue on a white or neutral background, indicating that blue wires are to be installed in circuits 5, 6, 11, 12, 17, 18, etc. Accordingly, by simply looking at this sheet, an electrician installing 208 volt three-phase service and needing to determine the appropriate color wire could, if faced with the question of what color wire to install in circuit number 28 he/she would immediately know that it is a red wire. The electrician could then remove the peel-off marker or label with the numbers 28 on it, attach it to the wire and install it, knowing without hesitation that he/she is installing the proper color-coded wire. Or if, for example, a number of wires is to be installed in a single conduit, such as wires for circuits 2, 15, 16, 18, 27, 31 and 34, the electrician would immediately know, without hesitation or error prone calculation, that he/she needs to install a black wire for circuit number 2, a red wire for each of circuits numbers 15 and 16, a blue wire for circuit number 18, a red wire for circuit number 27, a black wire for circuit 31, a red wire for circuit number 34. The labels could be removed, installed on the proper wire and the wires pulled or otherwise installed into the appropriate electrical service.

In accordance with the present invention, another advantage of the present invention, is that in three-phase electrical services, in the event the color of the identifier does not match the color of the wire, the electrician is immediately alerted to a potential error. This has significant advantages not only in the initial installation of the electrical service, but also in later servicing. If, for example, in post-installation servicing, an electrician sees that the color of the identifier does not correspond to the color of the wire, the electrician is immediately put on notice that there is a potential error in the original installation and that service for that electrical system must be approached very carefully. It is not uncommon for electricians to be called upon to service electrical systems while they are live. This is a dangerous undertaking that must be approached with care, and safeguards provided by the present invention would, while not eliminating all danger, provide another way for the electrician to be alerted to potential incorrect installations before servicing a live system if that is required. Nothing in this description, however, should be viewed as endorsing, encouraging, or permitting electrical service or maintenance of live electrical systems. Such service should always be carried out with the electrical system safely disconnected from the power source.

Figure 3:
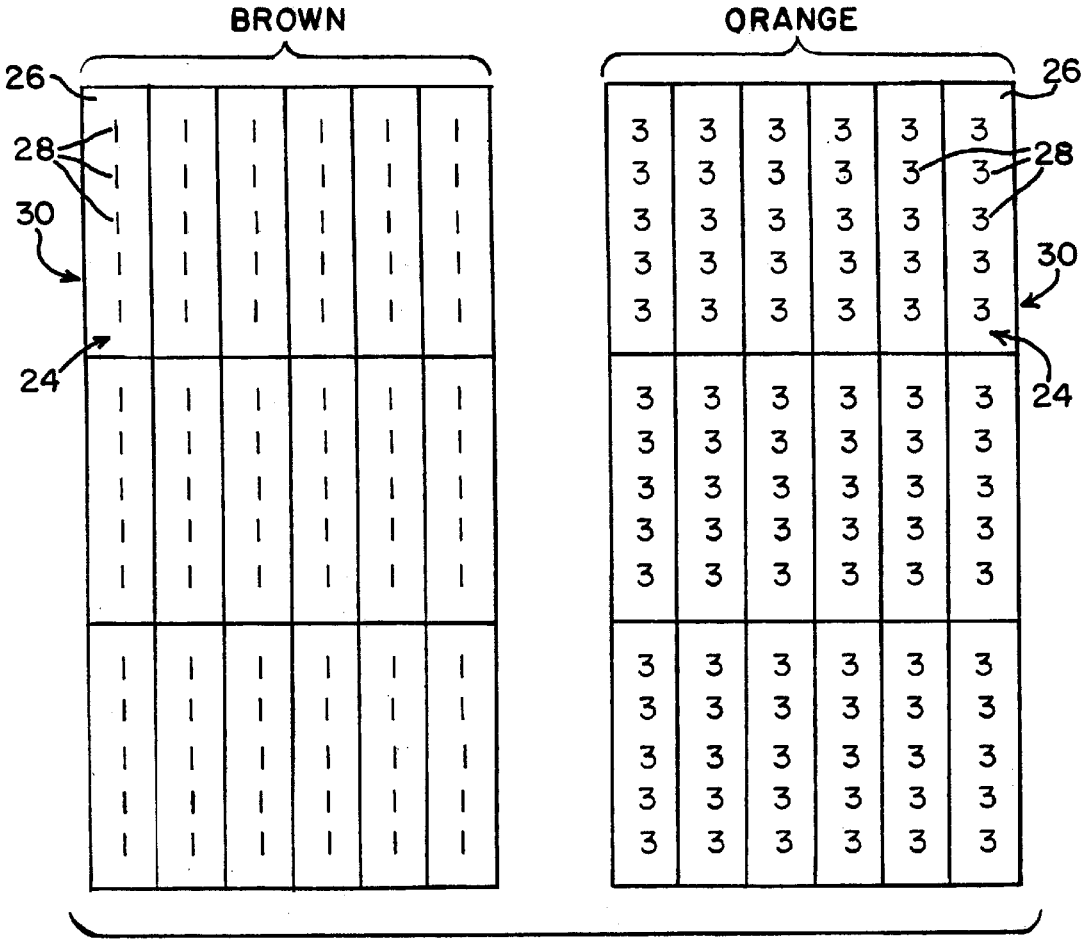
FIG. 3 is an alternative embodiment showing a source of wire markers embodying the present invention, in which the source comprises separate sheets, each sheet having only one number on it corresponding to the particular circuit in which the wire is to be installed and having a color indicator corresponding to the appropriate wire color for that particular circuit and phase in a 480 volt three phase electrical system.

FIG. 3 shows an alternative embodiment of the present invention, and uses the color coding for a 480 volt three-phase electrical system as an example. In FIG. 3, each page of wire markers contains markers of the same number. For example, one page of FIG. 3 shows wire markers all bearing the identifier number 1 and the other page of FIG. 3 shows another page of wire markers all bearing the identifier number 3. This embodiment is identical to that described above, except that each page contains markers having the same identifier and in this embodiment, the color indicia is provided by the background color of the marker or label itself. In other words, the entire indicia bearing surface or outside visible surface of the marker is of the color that is to be associated with the particular wire. For example, the background color of markers bearing the identifiers 1 and 2 is brown. The background color of markers bearing identifiers 3 and 4 would be orange, and the background color for markers bearing identifiers numbers 5 and 6, would be yellow. This color sequence would be repeated up to a sufficient number typically encountered by an electrician, such as 42. Having each sheet all of the same identifier and color indicia has the advantage of potential ease of manufacture, avoiding the need for multiple colors on a single page. Otherwise, the markers and the method of attachment to the page and the removal is the same as that described in connection with FIG. 2.

Figure 4:
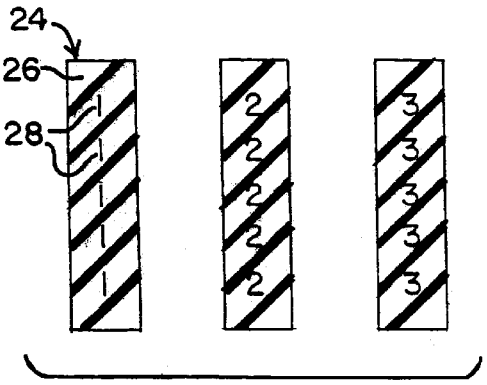
FIG. 4 shows an alternative embodiment of the present invention in which the circuit is identified by a number on the label, and the appropriate wire color is reflected by color cross hatching on the label surface.
Figure 5:
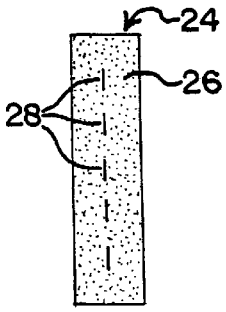
FIG. 5 shows a still further embodiment of the present invention in which the number of the circuit is identified on the label and the particular color for the appropriate wire for that circuit is shown by way of background color or stippling on the surface of the marker.
Figure 6:
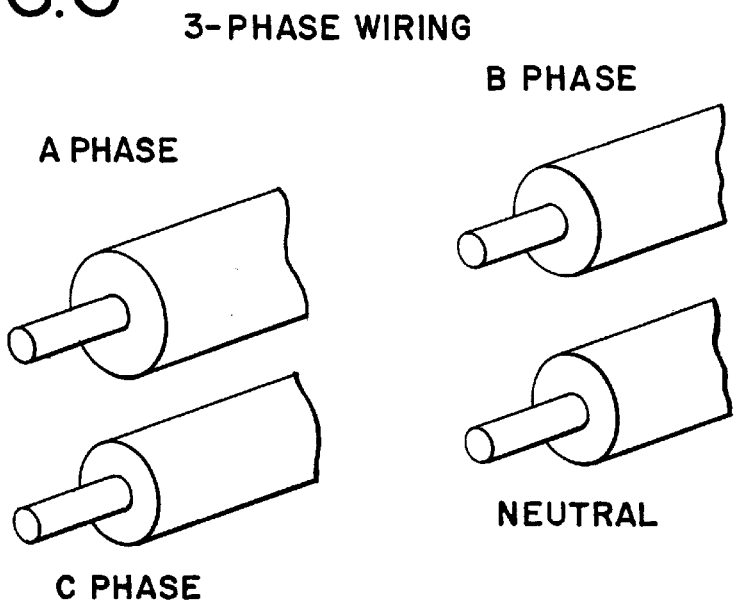
FIG. 6 shows three hot wires of a three-phase alternating current electrical service, each wire being identified with a particular phase A, B or C.
Figure 7:
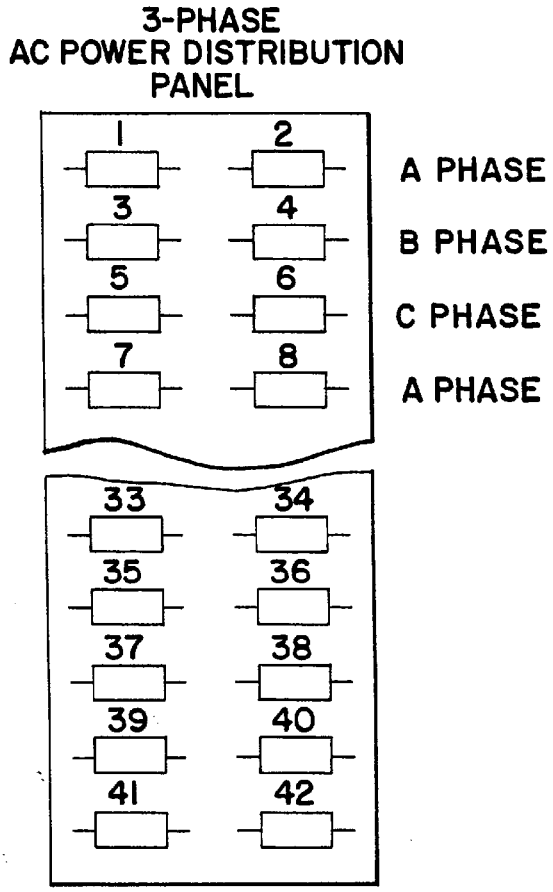
FIG. 7 shows a standard three-phase alternating current power distribution panel with circuits associated with each phase A, B or C.

FIGS. 4 and 5 represent alternative embodiments, showing different ways that the color indicia can be provided on the wire marker. In FIG. 4, for example, the identifier is provided by way of a number printed on the surface of the label in the same manner as disclosed earlier in FIGS. 2 and 3. In FIG. 4, however, the color indicia is provided by cross-hatching on the surface of the label with the appropriate color to be used for the wire. The use of cross-hatching for the color indicator has the potential advantage of allowing ease of printing and number identification. For example, the background color of the label shown in FIG. 4 could be white or an otherwise neutral color, the identifier numbers may all be in black for ready visibility against the white background and the cross-hatching could represent the particular color of the wire corresponding to the phase of that particular circuit. This arrangement allows use of contrasting colors for the identifier and the background for easy reading of the identifier number and provides for maximum contrast between the color indicia and the background for ready identification of the color indicia as well.

Finally, FIG. 5 shows another alternative embodiment of the present invention where the color indicia, instead of comprising cross-hatching comprises a stippling effect. Of course, the present invention is not limited to numerical identifiers or in particular a manner in which the color indicia is provided on the surface of the marker. The present invention is intended to include such other means for providing the color identifier as would be apparent to one skilled in the field, whether immediately apparent upon reading this description or apparent only after some study. For this reason, the present invention is not limited to the specific embodiment set forth in this written description, but is defined by the appended claims.

What is claimed is:

1. An electrical wire marking system comprising:

a 3-phase alternating current distribution source comprising a plurality of circuits, each circuit including a unique identifier symbol associated therewith and a particular color associated with the phase of such circuit;

an electrical wire connected to a particular one of said circuits, at least a portion of the surface of said wire including said particular color associated with the phase of said particular one of said circuits; and a wire marker carried by said wire, said wire marker including:

an identifier symbol corresponding to the unique identifier symbol associated with said particular one of said electrical circuits; and a color indicia corresponding to the color associated with the phase of said particular one of said circuits and the color of said portion of the surface of said wire.

2. The system of claim 1 in which said color indicia is defined by at least a portion of said identifier symbol comprising said particular color.

3. The system of claim 2 in which said identifier symbol is a number, and said number is essentially entirely comprised of said particular color.

4. The system of claim 1 wherein said marker further comprises an indicia bearing surface, said color indicia being defined by at least a portion of such surface comprising said particular color.

5. The system of claim 1 in which said marker further comprises an identifier symbol and indicia bearing surface.

6. The system of claim 5 in which said color indicia is defined by at least a portion of said surface comprising said particular color.

7. The system of claim 5 in which said color indicia is defined by at least a portion of said identifier symbol comprising said particular color.

8. The system of claim 5 in which said identifier symbol and indicia bearing surface is substantially entirely white and said identifier symbol is substantially entirely comprised of said particular color.

9. The system of claim 5 in which said identifier symbol and indicia bearing surface is substantially entirely comprised of said particular color and said identifier symbol is comprised of a different color.

10. The system of claim 5 in which said identifier symbol and indicia bearing surface comprises indicia selected from the group consisting of stripes and dots of said particular color and said identifier symbol is comprised of a different color.

11. The system of claim 5 in which said identifier symbol and indicia bearing surface includes an underside and said marker further comprises an adhesive on said underside, said adhesive attaching said marker to said electrical wire.

12. A method for identifying and connecting an electrical wire to a particular one of a plurality of circuits of a 3-phase alternating current distribution source, each of said circuits having a unique identifier symbol associated therewith and a particular color associated with the phase thereof and the wire to be connected thereto, comprising:

determining the unique identifier symbol associated with said particular one of said circuits;

providing a source of electrical wire markers attachable to electrical wires, said source including a plurality of electrical wire markers with at least one wire marker for each of said circuits, each wire marker having associated with it an identifier symbol corresponding to the unique identifier symbol of its respective circuit and indicia of a particular color associated with the phase of its respective circuit and the wire to be connected thereto;

determining from said source the particular color associated with the phase of said particular one of said circuits by viewing the color indicia associated with the wire marker having an identifier symbol corresponding to the unique identifier symbol of said particular one of said circuits;

providing an electrical wire having an outer surface, at least a portion of which has a color corresponding to said particular color associated with the phase of said particular one of said circuits;

attaching to said electrical wire said wire marker comprising said identifier symbol corresponding to the unique identifier symbol of said particular one of said circuits; and connecting said electrical wire to said particular one of said circuits.

13. The method of claim 12 in which the identifier symbol and color indicia associated with each wire marker are affixed thereon and at least a portion of said identifier symbol is comprised of the particular color associated with the phase of the respective circuit.

14. The method of claim 13 in which the identifier symbol of each marker is a number corresponding to the number of its respective circuit and the identifier symbol is comprised of the particular color corresponding to the phase of its respective circuit.

15. The method of claim 12 in which each marker further comprises a surface bearing the associated identifier symbol and color indicia.

16. The method of claim 15 in which at least a portion of the identifier symbol and color indicia bearing surface of each marker is comprised of the particular color corresponding to the phase of its respective circuit.

17. The method of claim 15 in which the identifier symbol and indicia bearing surface of each marker is substantially entirely white and the identifier symbol of each marker is substantially entirely comprised of the particular color corresponding to the phase of its respective circuit.

18. The method of claim 15 in which the identifier symbol and indicia bearing surface of each marker is substantially entirely comprised of the particular color corresponding to the phase of its respective circuit and the identifier symbol is comprised of a different color.

19. The method of claim 15 in which the identifier symbol and indicia bearing surface of each marker comprises indicia selected from the group consisting of stripes and dots of the particular color corresponding to the phase of its respective circuit and said identifier symbol is comprised of a different color.

20. The method of claim 15 in which the identifier symbol and indicia bearing surface of each marker includes an underside and an adhesive is disposed on said underside for attaching the marker to an electrical wire.

* * * * *